United States Patent [19]

Foster et al.

[11] 4,361,025

[45] Nov. 30, 1982

[54] WIRE BENDING MACHINE

[75] Inventors: Edwin E. Foster; Thomas E. Foster, both of Austin, Tex.

[73] Assignee: Michael Ladney, Jr., Grosse Pointe Shores, Mich.

[21] Appl. No.: 206,967

[22] Filed: Nov. 14, 1980

[51] Int. Cl.[3] ..... B21F 1/00

[52] U.S. Cl. ..... 72/381; 140/105

[58] Field of Search ..... 140/71 R, 87, 90, 91, 140/102, 105; 72/381, 382, 383, 384

[56] References Cited

U.S. PATENT DOCUMENTS

| | | | |
|---|---|---|---|
| 117,860 | 8/1971 | Bushnell | 140/102 |
| 403,923 | 5/1889 | Decker | 72/384 |
| 659,111 | 10/1900 | Soper | 72/383 |

*Primary Examiner*—Lowell A. Larson

*Attorney, Agent, or Firm*—Barnes, Kisselle, Raisch & Choate

[57] ABSTRACT

A machine for bending wire into a ring having a plurality of circumferentially spaced and radially outwardly projecting loops. A loop is formed by the cooperation of a pair of first mandrels longitudinally spaced apart on one side of a wire segment and a second mandrel normally positioned on the other side of the wire segment and moved generally transversely across the longitude of the wire segment along a path between the first mandrels while essentially simultaneously the first mandrels are moved generally longitudinally toward each other. Pairs of third and fourth mandrels disposed on opposite sides of the wire form bends in the wire to provide a plurality of rectilinear portions interconnecting adjacent loops to form a ring-like configuration.

4 Claims, 6 Drawing Figures

WIRE BENDING MACHINE

This invention relates to wire bending and more particularly, to a wire bending machine.

Wires have been bent in a variety of configurations for many different purposes. As disclosed in U.S. Pat. No. 4,027,919, a retainer ring bent from spring steel wire is useful as part of a mechanism for releasably retaining a wheel cover on a wheel of an automotive vehicle. The retainer ring has a plurality of circumferentially spaced and generally radially outwardly projecting loops. Preferably, the ring-like configuration of the retainer is formed by a plurality of essentially rectilinear portions interconnected by bends and extending between adjacent loops. Preferably, each loop has a return bend with a pair of legs which are essentially parallel to each other and each connected by a right angle bend to its immediately adjacent rectilinear portion so that it projects essentially at a right angle thereto. In order to achieve such right-angular relationships in the completed retainer ring, it is necessary to overbend portions of the wire so that when released, the legs of the loop and the immediately adjacent rectilinear portions will spring back to the desired essentially parallel and right angular relationships.

Objects, features, and advantages of this invention are to provide a bending machine which overbends a wire when forming a loop to produce a return bend having legs essentially parallel to each other, which overbends the wire to provide legs at essentially a right angle to an adjacent portion of the wire, which is of economical manufacture and assembly, and which easily, rapidly, and economically forms a loop with a return bend in a wire and a wire retainer ring having a plurality of such loops circumferentially space apart and interconnected by rectilinear portions.

These and other objects, features, and advantages of this invention will be apparent from the following detailed description, appended claims, and accompanying drawings in which:

Figure 1:
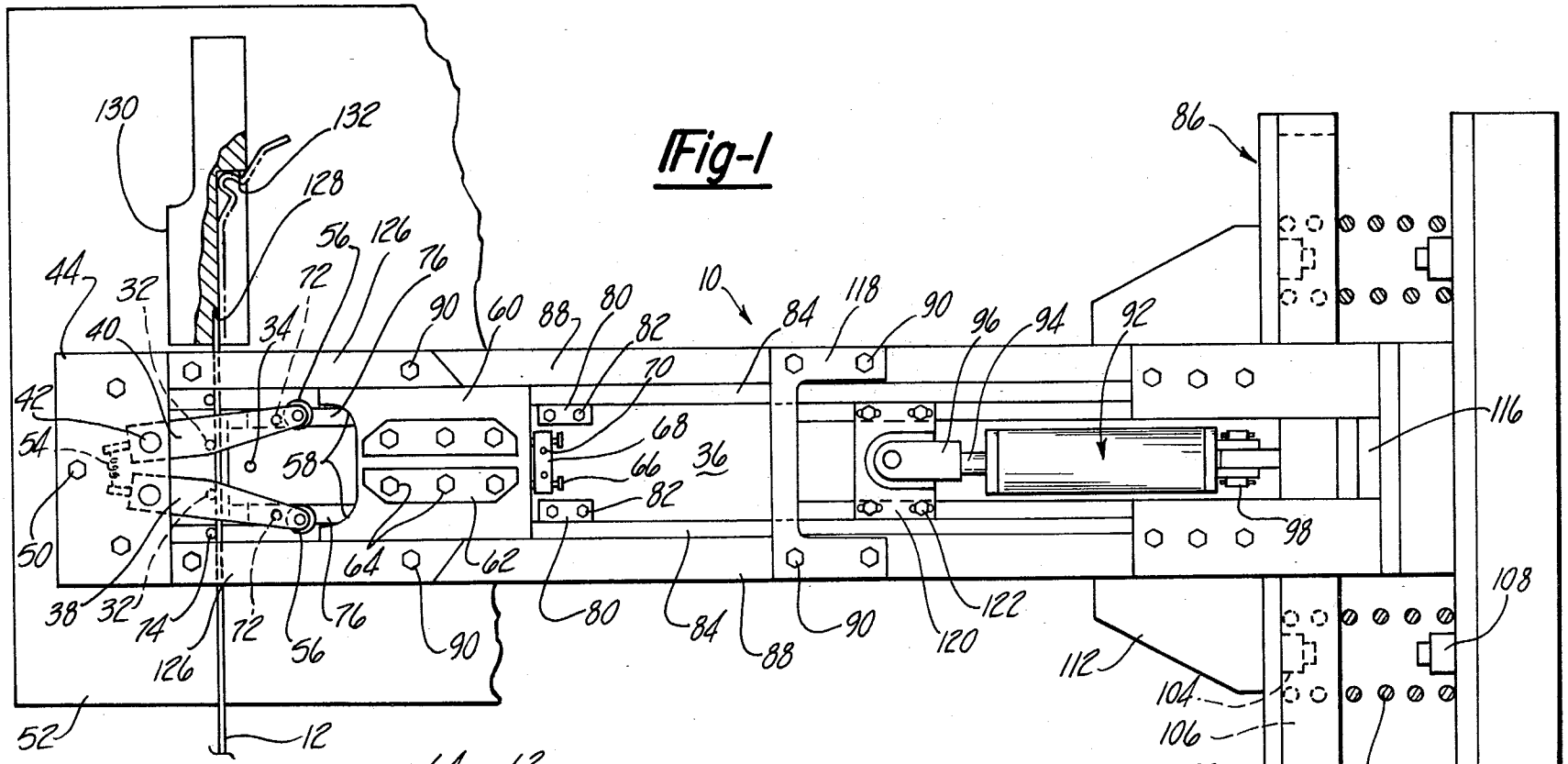
FIG. 1 is a plan view with portions broken away of a wire bending machine embodying this invention with its first slide fully retracted and its second slide fully extended.

Referring in more detail to the drawings, FIG. 1 illustrates a machine 10 embodying this invention which can bend a wire 12 of spring steel to form a retainer ring 14 (FIG. 6) having a plurality of equally circumferentially spaced apart and radially outwardly projecting loops 16. Each loop 16 has a return bend 18 and a pair of legs 20 which are essentially parallel to each other. Each leg 20 is connected by a sharp bend 22 to a relatively short rectilinear or straight line portion 24 which is at essentially a right angle to its associated leg 20. Each short portion 24 is connected by a sharp bend 26 to a straight line central longer portion 28. One of the central portions 28 comprises the end portions 30 of the wire from which the retainer ring is formed.

Figure 3:
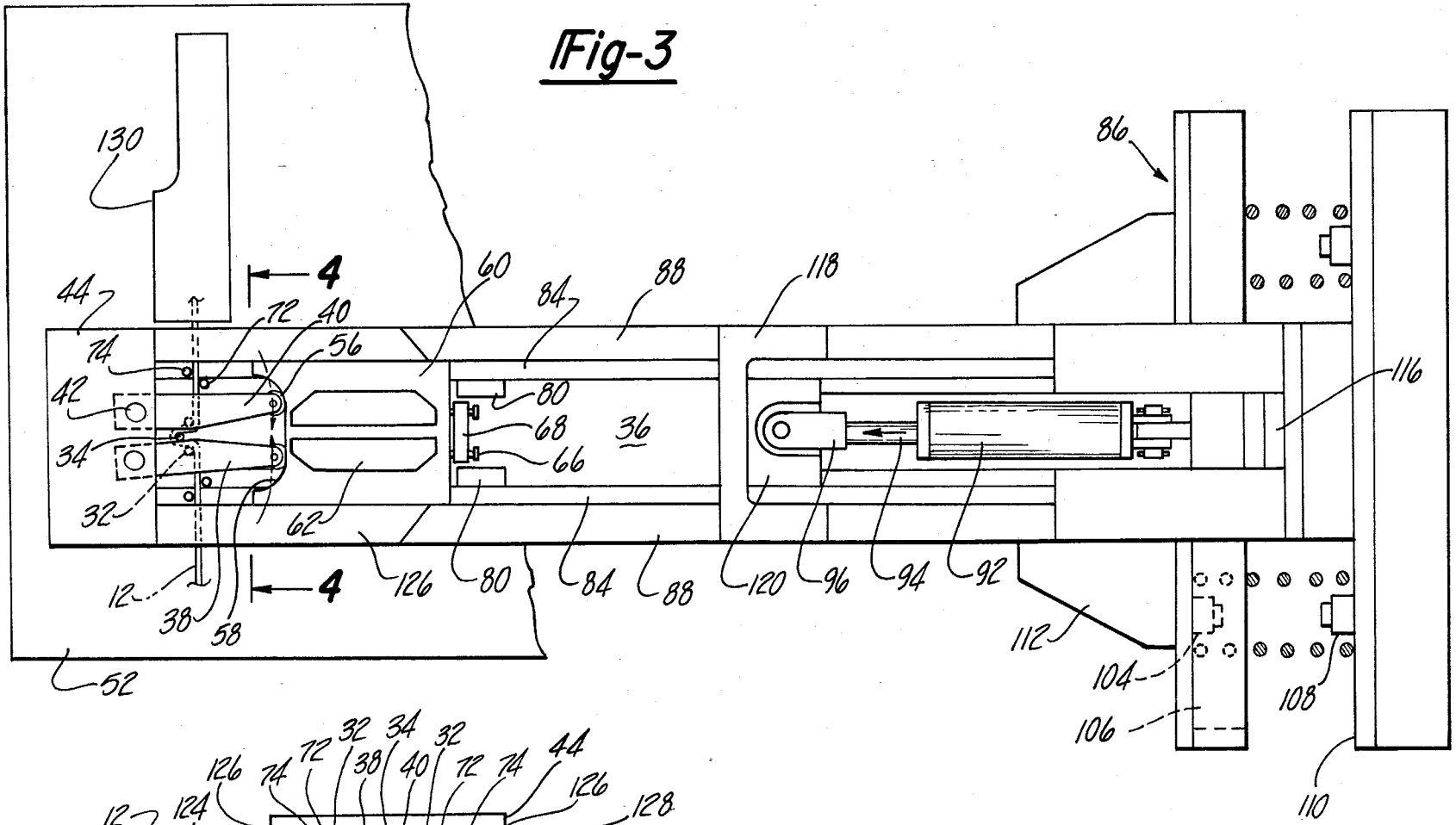
FIG. 3 is a plan view of the machine of FIG. 1 with both of its slides fully extended.
Figure 4:
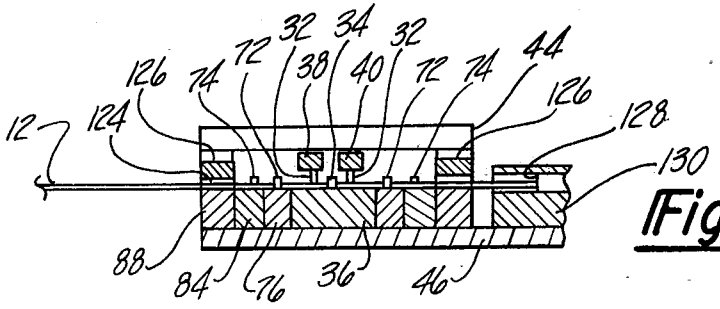
FIG. 4 is a fragmentary sectional view on line 4—4 of FIG. 3.

As shown in FIGS. 1 and 3, each loop 16 is formed in machine 10 by the cooperation of a pair of first mandrels or pins 32 and a second mandrel or pin 34 mounted on a slide 36. The first pins 32 are mounted on levers 38 and 40 which are pivoted at 42 to a carrier plate 44 and a base plate 46, secured together with spacer blocks 48 therebetween by cap screws 50. Base plate 46 is mounted on a table 52.

As shown in FIG. 3, each loop 16 is formed by advancing pin 34 transversely across a wire segment along a path between the pins 32 while essentially simultaneously moving the pins 32 longitudinally toward each other. The pins 32 are moved toward each other by pivoting lever arms 39 and 40 against the bias of a spring 54 connected to the lever arms. The lever arms are pivoted toward each other by cooperation of followers 56 mounted on the free end of each arm with cam surfaces 58 on a block 60 secured by retainer plates 62 and cap screws 64 to the slide 36. To permit adjustment of the point along the path of travel of pin 34 at which the pair of pins 32 begin to be actuated by the cams and followers, block 60 may be shifted longitudinally within predetermined limits on slide 36. Prior to being secured to the slide, block 60 may be shifted longitudinally by adjustment screws 66 which bear on the rear of the cam block 60 and are threaded into a mounting block 68 secured by screws 70 to the slide.

Figures 5, 6:
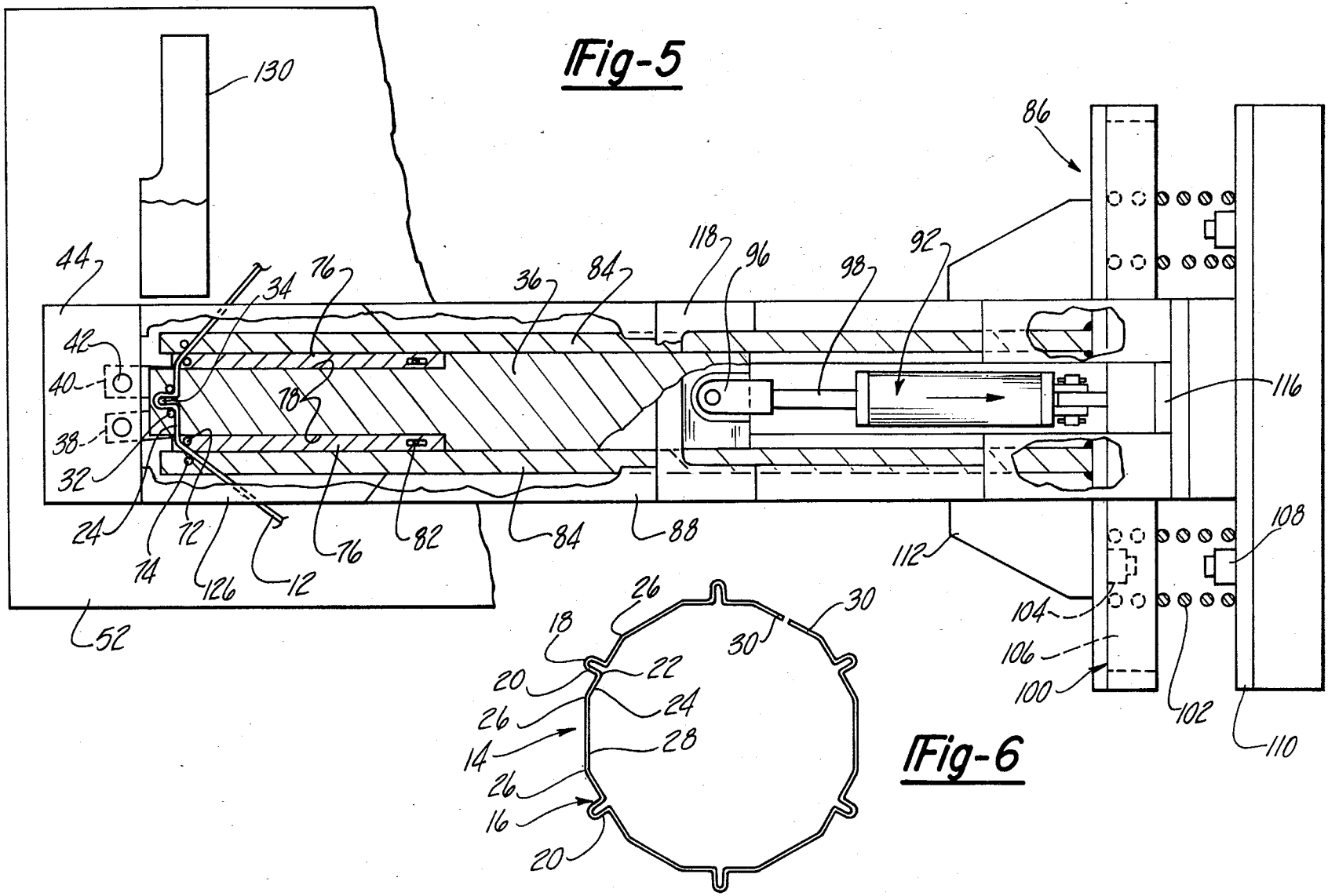
FIG. 5 is a plan view with portions broken away of the machine of FIG. 1 with its first slide fully extended and its second slide fully retracted.
FIG. 6 is a plan view of a wire retainer ring of spring steel produced by the machine of FIG. 1.

As shown in FIG. 5, a pair of the bends 26 in ring 14 are formed by the cooperation of a third pair of mandrels or pins 72 and a fourth pair of mandrels or pins 74. Pins 72 are moved by the slide 36 in unison with the pin 34. Each pin 72 is mounted on a carrier bar 76 which is slidably received in a recess 78 of the slide 36 and releasably secured to the slide for movement therewith by a clamp block 80 and cap screws 82. As shown in FIG. 3, carrier bars 76 are positioned on the slide 36 so that the pins 72 lie closely adjacent the wire 12 when the pin 34 has been fully extended by the slide to form a loop 16 and associated bends 22 of the retainer ring. Each pin 74 is mounted on a carrier bar 84 of a second slide 86. Bars 84 are slidably received on the base plate 46 between the first slide 36 and a pair of keepers 88 secured by cap screws 90 to the base plate 46.

Both the first and second slides 36 and 86 are sequentially actuated by a hydraulic cylinder 92. A piston rod 94 of the cylinder 92 is connected to the first slide 36 by a clevis pin assembly 96. The housing of cylinder 92 is connected to the second slide 86 by a clevis pin assembly 98 secured to a pressure plate assembly 100 fixed to the ends of the bars 84 for movement therewith.

As shown in FIG. 3, the second slide 86 is yieldably biased to its extended position by compression springs 102. These springs also apply sufficient force to the second slide 86 to assure that when cylinder 92 is actuated, it first fully advances the slide 36 before beginning to retract the slide 86. One end of each spring 102 is positioned by a locator 104 in a pocket 106 in the pressure plate assembly 100 and the other end of each spring is positioned by a locator 108 to bear on a bolster plate 110. Bolster plate 110 is fixed to a carrier plate 112 secured by cap screws 90 and 114 to the base plate 46.

The extent to which the second slide 86 can be retracted is limited by a positive stop 116 fixed to the carrier plate 112 and positioned to bear on the pressure plate assembly 100. The extent to which the first slide 36 can be extended is limited by the cooperation of an abutment plate 118 fixed by cap screws 90 to the base plate 46 and an adjustable stop 120 secured by cap screws 122 to the first slide 36.

Figure 2:
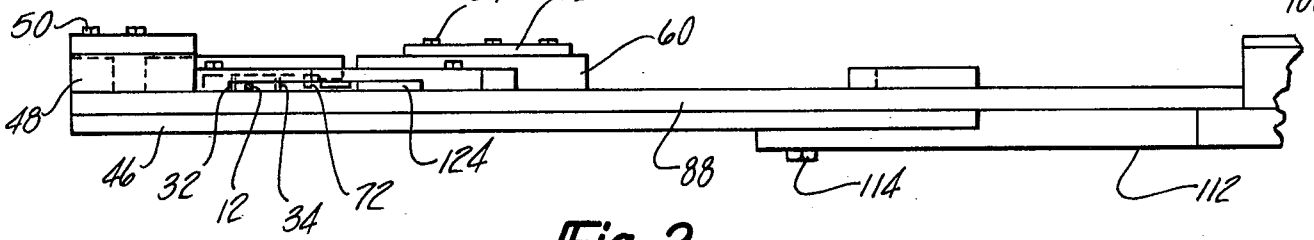
FIG. 2 is a fragmentary side view of the machine of FIG. 1.

As shown in FIGS. 1 and 2, when the slide 36 is fully retracted and the slide 86 is fully extended, the wire 12 is fed into the machine 10 between the pins 32 and 34 through slots 124 formed by the cooperation of the keepers 88 and guide blocks 126 secured by cap screws 90 to the keepers. The extent to which a straight wire 12 can be initially fed into the machine 10 is controlled and limited by the engagement of its free end with a first abutment 128 in a stop block 130 secured to the table 52. In forming a retainer ring 14, the generally circumferential distance between adjacent loops 18 is limited and controlled by engagement of the most recently formed loop with a second abutment 132 in the block 130 (as shown in phantom in FIG. 1) which is spaced generally longitudinally downstream from the first abutment 128.

In using machine 10 to form a retainer ring 14, as shown in FIG. 1, a free end of the wire 12 is fed into the machine through guide slots 124 between the pins 32 and 34 until the free end of the wire engages the first stop 128. A loop 16 and its associated bends 22 are formed by admitting hydraulic fluid under pressure into the cylinder 92 to fully advance the slide 36 so that the stop 120 bears on the abutment plate 118. As shown in FIG. 3, this moves the pin 34 transversely across the longitude of the wire along a path between the pins 32 while essentially simultaneously the cams 58 and followers 56 pivot the lever arms 38 and 40 to move the pair of pins 32 toward each other, thereby forming a loop 16 with a return bend 18 and legs 20 terminating in sharp bends 22. Preferably, the cams 58 are arranged and positioned on the slide 36 so that the lever arms 38 and 40 move the pins 32 close enough to each other to overbend the wire at return bend 18 and sharp bends 22 sufficiently so that when the wire is released, the legs 20 of the loop are parallel to each other and each leg extends essentially at a right angle to its associated straight portion 24 of the completed ring.

Thereafter, a bend 26 is formed in the wire on each side of the loop 16 by further actuation of the cylinder 92 to fully retract the second slide 86 against the bias of the springs 102 so that the pressure plate assembly 100 bears on the positive stop 116. As shown in FIG. 5, this retracts pins 74 to bend the wire around the pins 72 to form the bends 26 which interconnect the associated straight portions 24 and 28 of the ring 14.

After the bends 26 are formed, pressurized fluid is supplied to cylinder 92 to retract its piston rod 98 which, in cooperation with the springs 102, sequentially extends slide 86 and then retracts slide 36, thereby disengaging all of the pins 32, 34, 72 and 74 from the wire. The wire 12 with the loop 16 and its associated bends 22 and 26 formed therein is then further advanced through the guide slots 124 until as shown in phantom in FIG. 1, the loop bears on the second abutment 132 of the stop block 130. The cylinder 92 is then cycled to form another loop 16 and its associated pairs of bends 22 and 26 in the wire. This sequence of in infeeding the wire and forming a loop 16 and its associated bends is repeated until the entire ring 14 is completely formed.

I claim:

1. A wire bending machine comprising a base, a wire guide carried by said base and constructed and arranged to position a segment of a wire to extend generally longitudinally, a pair of levers carried by said base, a pair of first mandrels each carried by one of said levers and disposed in longitudinally spaced apart relationship adjacent one side of the segment of wire carried by said guide, a first slide carried by said base, a second mandrel carried by said slide and, when said slide is retracted, disposed on the other side of the segment of wire, said first slide being constructed and arranged to advance said second mandrel generally transversely to and across the longitude of the segment of wire along a path passing between said first mandrels, and a cam and a follower associated with each lever with one of the cam and follower carried by said first slide and the other carried by its associated lever, each said cam, follower and associated lever being constructed and arranged to move said first mandrels toward each other essentially simultaneously with advancement by said first slide of said second mandrel across the longitude of the segment of wire along the path between said first mandrels, whereby a loop is formed in the wire segment having a return bend and a pair of legs extending generally transversely to the longitude of the segment of wire, a third pair of mandrels spaced apart longitudinally beyond said first mandrels and disposed on said other side of the segment of wire, a second slide carried by said base, a pair of fourth mandrels carried by said second slide in spaced apart relation longitudinally beyond said pair of third mandrels and normally disposed on said one side of the segment of wire and said second slide being constructed and arranged to move said pair of fourth mandrels generally transversely across the longitude of the segment of wire to bend the wire around said third mandrels, whereby portions of the wire distal from said legs of said loop are inclined with respect to each other and with respect to portions of the wire disposed between said legs and said first mentioned inclined portions.

2. The machine of claim 1 which also comprises said third mandrels being operably connected with said first slide for advancement essentially in unison with said second mandrel to engage the segment of wire and in cooperation with said first mandrels form a bend in the wire at the distal end of each leg of the loop formed by the cooperation of said first and second mandrels.

3. The machine of claim 1 which also comprises an actuator operably connected with said second slide and constructed and arranged to move said fourth mandrels to bend the segment of wire around said third mandrels only after said first slide has moved said first and second mandrels to form the loop in the segment of wire.

4. The machine of claim 1 which also comprises an actuator operably connected with both said first slide and said second slide and constructed and arranged to simultaneously apply a force to both of said slides tending to move both said second mandrel and said fourth mandrels toward the segment of wire, a stop limiting the extent to which said first slide can be advanced by said actuator, and means yieldably retaining said second slide in a position such that the application of force by said actuator to both of said slides initially moves said first slide to form a loop in the segment of wire and then subsequently moves said second slide to bend the segment of wire about said third mandrels.

* * * * *